United States Patent [19]

Rasero et al.

[11] 4,174,739

[45] Nov. 20, 1979

[54] TUBULAR FABRIC

[75] Inventors: Lawrence J. Rasero; John Pelchuck, Jr., both of Middletown; Gordon H. Howard, Andover, all of Conn.

[73] Assignee: Fenner America Ltd., Middletown, Conn.

[21] Appl. No.: 880,120

[22] Filed: Feb. 21, 1978

[51] Int. Cl.[2] ..... D03D 3/02

[52] U.S. Cl. ..... 139/388; 139/408

[58] Field of Search ..... 139/383 A, 387 R, 388, 139/408, 409, 410, 411, 412, 413, 414; 74/231 R, 232, 233

[56] References Cited

U.S. PATENT DOCUMENTS

| | | | |
|---|---|---|---|
| 595 | 8/1858 | Cooley et al. | 139/388 |
| 200,965 | 3/1878 | Baker | 139/387 R |
| 1,994,280 | 3/1935 | Hindle | 139/383 A |
| 2,090,547 | 8/1937 | Neaves | 139/408 |
| 2,134,421 | 10/1938 | Walters | 139/388 |
| 2,330,405 | 9/1943 | Case | 74/232 |
| 2,356,342 | 8/1944 | Orgass | 139/388 |
| 2,523,637 | 9/1950 | Starfield et al. | 139/387 R |
| 2,607,713 | 8/1952 | Waugh | 74/232 |
| 2,672,168 | 3/1954 | Walters | 139/388 |
| 2,866,483 | 12/1958 | Watts et al. | 139/412 |
| 2,934,097 | 4/1960 | Hindle et al. | 139/383 A |
| 3,749,138 | 7/1973 | Rheaume et al. | 139/408 |
| 3,944,060 | 3/1976 | Hartmann | 139/411 |

FOREIGN PATENT DOCUMENTS

| | | | |
|---|---|---|---|
| 1636192 | 12/1970 | Fed. Rep. of Germany | 139/383 A |
| 1207446 | 9/1970 | United Kingdom | 139/383 A |
| 1220531 | 1/1971 | United Kingdom | 74/232 |

*Primary Examiner*—Henry Jaudon
*Attorney, Agent, or Firm*—Sherman & Shalloway

[57] ABSTRACT

A tubular fabric for use as a carcass for power transmission and conveyor belts. A plurality of longitudinal warp yarns and a plurality of transverse weft yarns are interwoven in a warp weave wherein the transverse weft yarns form adjacent pairs having upper yarns and lower yarns. The longitudinal warp yarns pass above a first upper yarn of a pair of transverse weft yarns, between a second upper yarn and a second lower yarn of a second pair of transverse weft yarns adjacent the first pair, below a third lower yarn of a third pair of transverse weft yarns adjacent the second pair and between a fourth upper yarn and a fourth lower yarn of a fourth pair of transverse weft yarns adjacent the third pair.

From a planar view of the surface of the tubular fabric, the yarns are substantially perpendicular and have a weft weave which has the same configuration as the warp weave. At recurrent intervals, the longitudinal warp yarns and transverse weft yarns pass over, between, under and between the transverse weft yarns and longitudinal warp yarns, respectively. The symmetrical two-ply construction results in each warp yarn and weft yarn appearing on the inner and outer surface of the tubular fabric. This also results in the yarns being arranged in a one-third broken twill order wherein the warp and weft yarns are arranged in a 4-end satin order. As described above, the fabric is two-ply and it can also be woven in three and four-ply layers by interweaving a layer of the tubular fabric with a layer of another tubular fabric.

4 Claims, 10 Drawing Figures

WARP WEAVE (4-PLY)

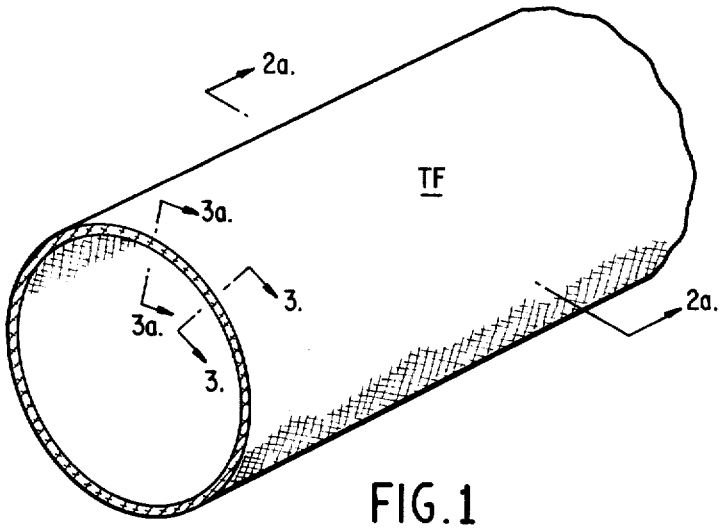
FIG. 1
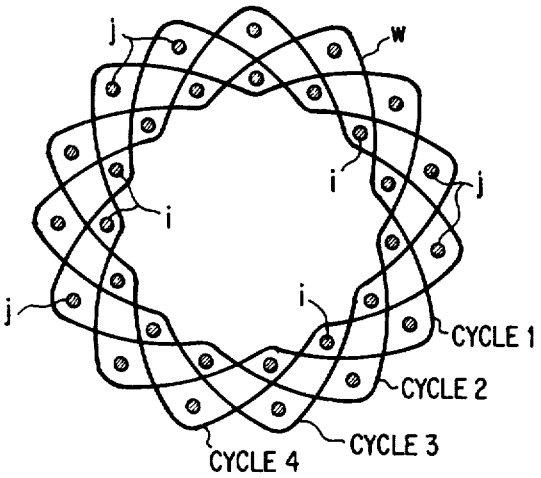
FIG. 2a WEFT WEAVE (2-PLY)

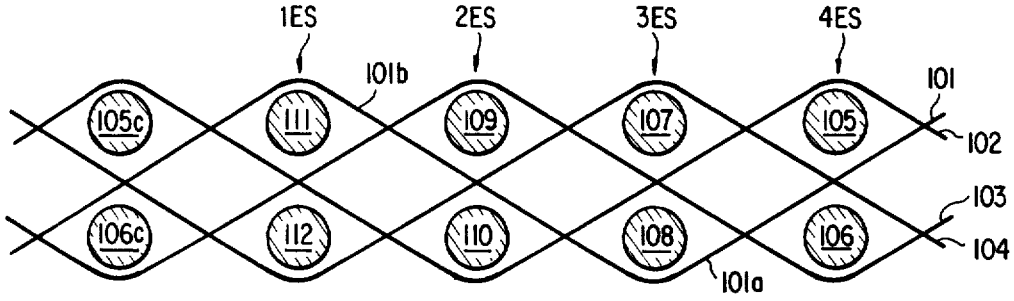
FIG. 2 WEFT WEAVE (2-PLY)
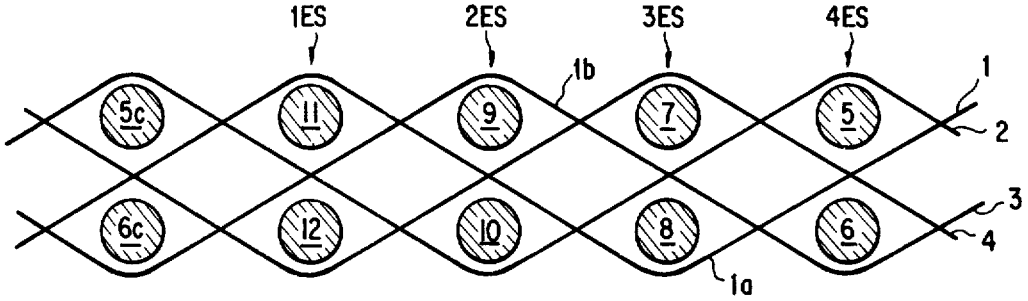
FIG. 3 WARP WEAVE (2-PLY)
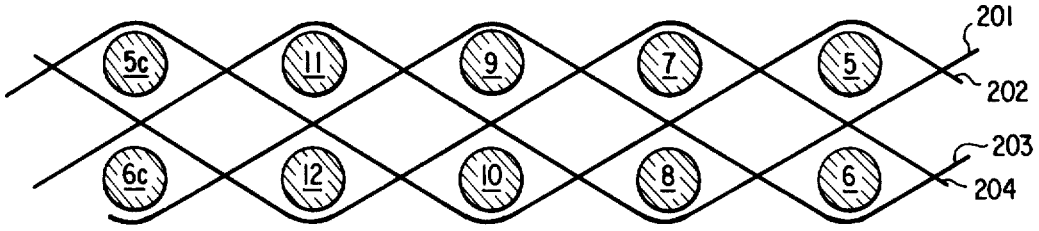
FIG. 3a WARP WEAVE (2-PLY)
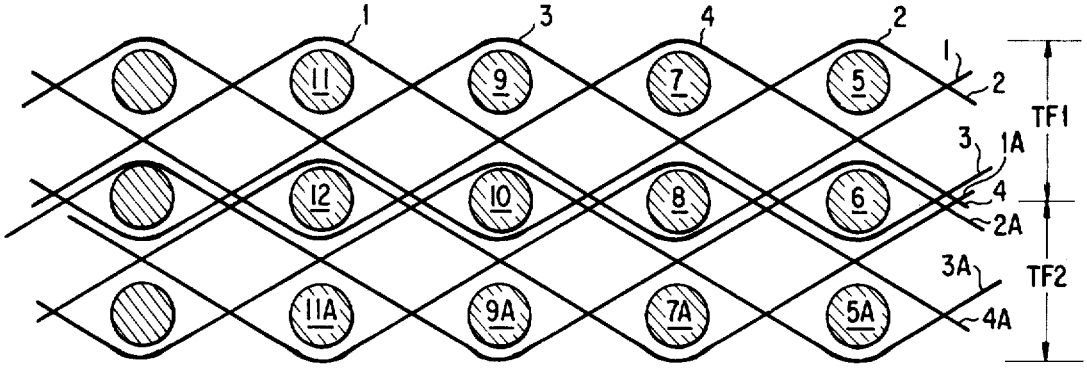
FIG. 5 WARP WEAVE (3-PLY)

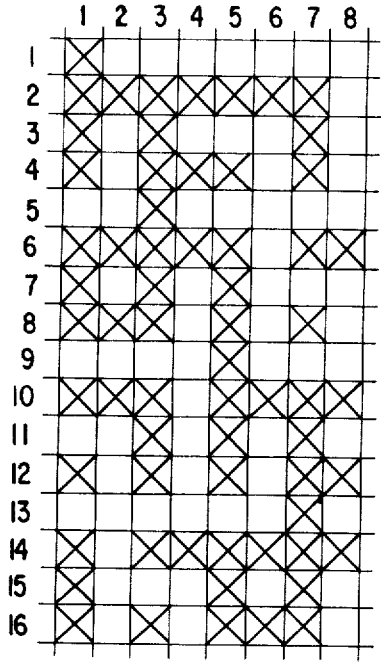
FIG. 4 2-PLY WEAVE PATTERN
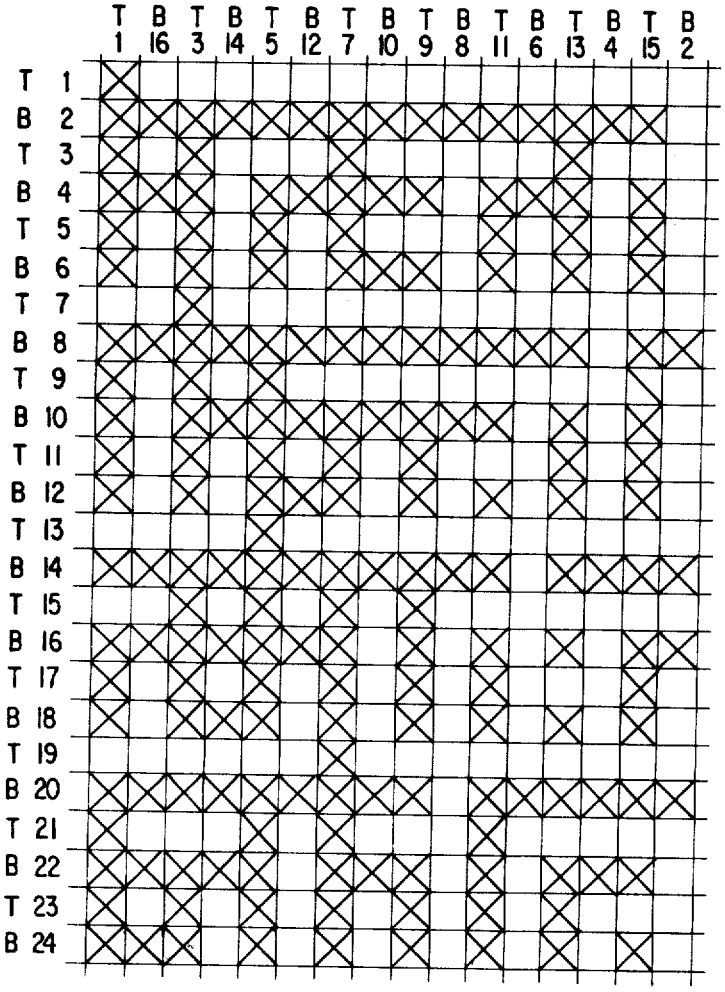
FIG. 7 3-PLY WEAVE PATTERN

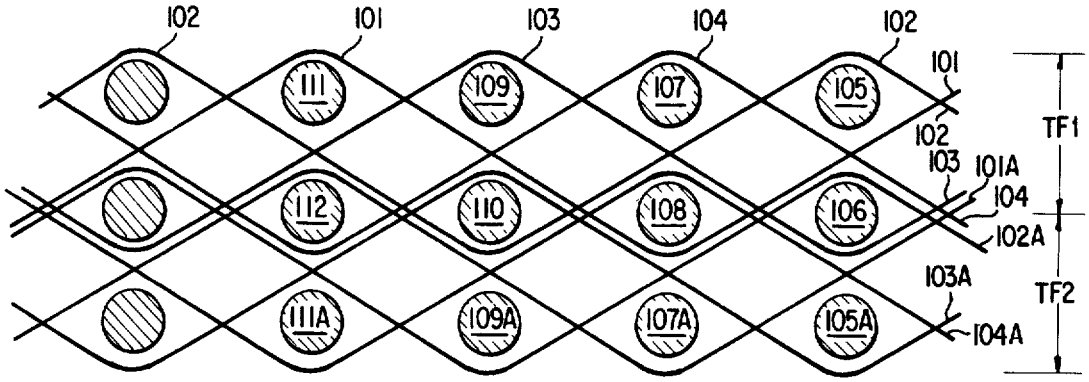
FIG. 6 WEFT WEAVE (3-PLY)
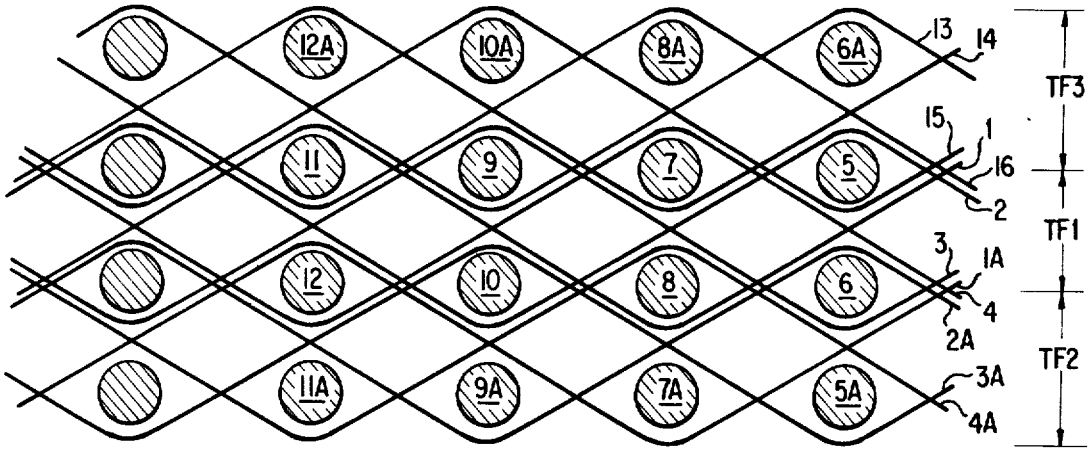
FIG. 8 WARP WEAVE (4-PLY)

TUBULAR FABRIC

BACKGROUND OF THE INVENTION

1. Field of the Invention

This invention concerns endless woven bands of tubular fabrics which are used as a carcass for power transmission and conveyor belts and dryer felts. In particular, the field of invention relates to a fabric which is in tubular form and has a longitudinal warp weave and a transverse weft weave which are the same configuration.

2. Description of the Prior Art

The prior art discloses many types of woven fabrics. In U.S. Pat. No. 200,965, Baker discloses a fabric wherein, in the case of a three-ply fabric, one-half of the warps of the inner and outer plys passes alternatively over and under the weft in nearly a straight line, while the remaining portion of the warps of the outer and inner plys passes diagonally around the central lines of the weft, and is thus used to form an intermediate ply. In the case of a four-ply fabric, Baker teaches that one-half of the warps of the inner and outer plys is arranged as the three-ply fabric, while the remaining portion of the warps of the outer and inner plys passes respectively around that line of weft which is adjacent to the outer and inner ply, and is thus used to form intermediate plys which are locked together by a separate series of warps which pass diagonally from one to the other of said intermediate plys.

In U.S. Pat. No. 1,994,280, issued to Hindle, dryer felts for use on paper making machines are disclosed. Therein is described a two-ply fabric in which the weave is composed of eight warp threads and two layers of weft threads, three of the warps being woven in to form one layer with each pick of one weft thread, three of the warps being woven in to form the second layer with each pick of the second weft thread and two warps being woven in each alternative pick by both weft threads to bond the two layers together whereby all the eight warp threads are the same length and under the same tension in the felt. This results in a fabric composed of two layers of weft threads and eight coarse warp threads, three of the warps forming the top layer, three of the warps forming the bottom layer and two warps serving to bind the two layers together and also to complete the top and bottom faces of the fabric, the two binding warps being woven by the weft threads on each alternative pick.

Hindle, et al. discloses additional types of paper makers' dryer felts in U.S. Pat. No. 2,934,097. In particular, Example 2 shows a two-layer structure having weft and warp ends interwoven so as to appear on both the face and back of the felt, the surface warp yarns being arranged in one-third broken twill order. In addition, Example 4 teaches a two-layer felt having weft layers and warp layers which appear on both the face and back of the fabric and are arranged in a 6-end satin order. The fabric disclosed by Hindle, et al. is of symmetrical construction such that the crossing points of adjacent warps are always equidistant from successive wefts of the face layer, while successive wefts of the face layer are always directly above successive wefts of the back layer.

Watts, et al., in U.S. Pat. No. 2,866,483, teaches a reinforced power transmission and conveyor belt made of woven textile materials. A three-ply textile fabric is shown which consists of alternating sections in which weft threads are disposed across the width of the strip and warp threads are disposed parallel to the length of the strip.

In British Pat. No. 1,220,531, Aktiebolaget teaches a machine cloth for paper making, the main feature of which is the weft layer of the cloth being directed toward the material to be dewatered.

Basically, the prior art differs from the invention disclosed herein which includes a longitudinal warp weave which has the same configuration as a transverse weft weave.

The disclosed weave structure provides a tubular fabric which has a reduced cost and increases the quality of rubber impregnated, endless high speed belts. The belts are made from the tubular fabric or sleeve by cutting from a continuously woven piece of tubing, impregnating the cut piece with resins and rubbers, and vulcanizing the impregnated, cut piece. The vulcanized sleeve is then slit to a desired width.

In the prior art, two separate pieces of woven tubing were used, in order to obtain the desired strength, one piece slid over the other piece. After the separate pieces were finally vulcanized, a cloth wrapper was used on the outside to give the desired surface finish.

SUMMARY OF THE INVENTION

It is an object of this invention to provide a tubular fabric structure wherein the weft yarns are substantially perpendicular to the warp yarns.

An object of the present invention is to provide an endless woven belt having a very uniform structure, precisely controlled by the weaving process, resulting in a less labor intensive and more inexpensive belt than the sewn belts of the prior art.

It is a further object of this invention to describe a weave for a tubular fabric wherein the warp yarns pass at recurrent intervals over, between, under and between the weft yarns and the weft yarns pass at recurrent intervals over, between, under and between the warp yarns.

It is a further object of this invention to disclose a two-ply tubular fabric wherein each transverse weft yarn appears on the inner and outer surface of the tubular fabric and each longitudinal warp yarn appears on the inner and outer surface of the tubular fabric.

Another object of this invention is to teach a weave for a tubular fabric wherein the weft yarns are arranged in a one-third broken twill order and the warp yarns are arranged in a one-third broken twill order.

It is a further object of this invention to describe a tubular fabric wherein all yarns form a symmetrical construction such that a crossing point of adjacent warp weaves is equidistant from successive weft weaves of the outer surface and successive weft weaves of the outer surface are always above successive weft weaves of the inner surface.

It is a further object of this invention to teach a tubular fabric wherein the longitudinal warp yarns are arranged in 4-end satin order and the transverse weft yarns are arranged in 4-end satin order.

Still another object of this invention is a tubular fabric wherein the longitudinal warp yarns define first, second, third and fourth substantially parallel planes; the transverse weft yarns form fifth, sixth, seventh and eighth substantially parallel planes; the first and second planes binding the fifth plane to the eighth plane and the third and fourth plane binding the sixth plane to the seventh plane.

It is yet a further object of this invention to describe a tubular fabric which has a weave adaptable to two, three and four-ply configurations.

It is an object of the present invention to produce belts which are endlessly woven and can be cut laterally from a woven tube.

It is a further object of this invention to provide belts which can be woven from modern yarns and as used in the manufacture of car and truck tires precisely woven under controlled conditions.

It is a further object of this invention to provide belting which has application in the business machine field as well as industry wherein a tubular fabric can be impregnated with rubbers and resins to add life and friction and other qualities as need arises in the application.

The invention includes a tubular fabric which has a warp weave having the same configuration as a weft weave. Longitudinal and transverse yarns are interwoven in a warp weave wherein the transverse weft yarns form adjacent pairs having upper yarns and lower yarns. The longitudinal warp yarns pass above a first upper yarn of a first pair of transverse weft yarns, between a second upper yarn and a second lower yarn of a second pair of transverse weft yarns adjacent the first pair, below a third lower yarn of a third pair of transverse weft yarns adjacent the second pair and between a fourth upper yarn and a fourth lower yarn of a fourth pair of transverse weft yarns adjacent the third pair.

The longitudinal yarns are substantially perpendicular to the transverse yarns and the configuration results in the longitudinal yarns passing at recurrent intervals over, between, under and between the transverse yarns and the transverse yarns passing at recurrent intervals over, between, under and between the longitudinal yarns. In the two-ply configuration, each longitudinal yarn appears on the inner and outer surface of the tubular fabric and each transverse yarn appears on the inner and outer surface of the tubular fabric. All yarns are arranged in a one-third broken twill order and a 4-end satin order. The resulting weave of the tubular fabric allows a bottom layer of the tubular fabric to be interwoven with a top layer of another tubular fabric.

BRIEF DESCRIPTION OF THE DRAWING

These features and objects, as well as others, will become apparent to those skilled in the art by referring to the drawing in which:

FIG. 1 is an oblique view of a section of a two-ply tubular fabric having the weave structure of the invention;

FIG. 2 is a partial, enlarged cross-sectional view taken along 2—2 of FIG. 1 showing the weft weave of the two-ply tubular fabric of the invention;

FIG. 2*a* is a weft cross-section of the tubular fabric showing the weft weave cycle;

FIGS. 3 and 3*a* are partial enlarged cross-sectional views taken along lines 3—3 and 3*a*—3*a*, respectively, of FIG. 1 showing the warp weave of the two-ply tubular fabric of the invention;

FIG. 4 is a diagram of the two-ply weave pattern of the tubular fabric of FIGS. 1, 2 and 3;

FIG. 5 is a partial, enlarged cross-sectional view showing the warp weave of the three-ply tubular fabric of the invention;

FIG. 6 is a partial, enlarged cross-sectional view showing the weft weave of the three-ply tubular fabric of the invention;

FIG. 7 is a diagram of the three-ply weave pattern of the tubular fabric of FIGS. 5 and 6; and FIG. 8 is a partial, enlarged cross-sectional view showing the warp weave of the four-ply tubular fabric of the invention.

DESCRIPTION OF THE PREFERRED EMBODIMENT

The purpose of this invention is to provide a weave which results in a two-ply fabric which is equal to the two separate woven sleeves used in the prior art. The invention gives the weave the desired surface finish so that a considerable reduction in cost is achieved. The fabric is woven in tubular form and in an endless length. Lateral cuts are made in the tubing and the cut tubing is impregnated with resins and rubbers and vulcanized to a finished sleeve from which the desired widths of belt are cut. The weave is identical in both the weft weave and in the warp weave making a balanced low carrying member when cut laterally into a sleeve.

The weave is also adaptable for use as a three-ply and four-ply fabric. The multi-ply tubular fabric is also useful in several ways without impregnation. For example, the tubular fabric forms porous endless belts that permit gas to escape when woven with high temperature resistant fibers. Therefore, the woven fabrics would be useful as an endless belt in an oven of the commercial type wherein cakes, cookies and biscuits and such have gas eminating therefrom while being cooked. Heat resistant yarns such as fiberglass, teflon fluorocarbon and metal can be used in this regard.

The woven tubular fabric can be made on a conventional loom using commercial yarns of varying compositions. The weave permits structures which have a thickness not usually associated with tubular woven fabrics. The porosity of the tubular fabrics also allows air to be abstracted through the endless belt. This allows application of the fabric in situations where a vacuum is used through an endless belt to hold objects in position on the belt. Other applications of the belt include the use of the endless belts made from the tubular fabric in business machines for moving papers, in post office machines for handling mail and as a filter bag. The filter bag is formed by closing up one end of the tubular fabric and directing the medium to be filtered through the bag. Because of the endlessly woven aspect of the tubular fabric, lateral cuts can conveniently be made in the fabric.

The invention eliminates the need for splicing to create an endless form. In small modern machinery, such spliced belts are not suitable. Belt tensioning devices take up valuable space and are not required if the tubular woven belts described herein are composed of yarns having a good machine elasticity and having inherent stretch capabilities.

Heretofore, endless belts have been made from thin flat fabrics of commercially available yarns of all types. The process consists of a bias cut at each end and wrapping like a bandage of several plys and sewing the seams of the cut side by side. These sewn belts made from flat fabrics were sewn on a conventional sewing machine, each seam continuous, side by side, strengthening the belt and making it rigid. The belts were then heat set, wet-out, stretched, dried and sometimes impregnated with rubbers, resins or other life extending materials.

Normally, belts made in the prior art were constructed from a single ply tubing. To achieve extra thickness, the extra layers were created by placing one tube inside another. The disclosed invention provides a method for multiplying extra layers through the weaving process.

FIG. 1 is an oblique view of a portion of the tubular fabric TF. FIG. 3 is a cross-sectional view of the warp weave of the tubular fabric TF taken along line 3—3 of FIG. 1. In particular, it can be seen that the warp weave is comprised of a plurality of longitudinal or warp yarns 1, 2, 3 and 4 interwoven with a plurality of transverse or weft yarns 5, 6, 7, 8, 9, 10, 11 and 12. The yarns form a warp weave wherein the transverse yarns form adjacent pairs 5 and 6, 7 and 8, 9 and 10, and 11 and 12 having upper yarns 5, 7, 9 and 11 and lower yarns 6, 8, 10 and 12. Each longitudinal or warp yarn passes above a first upper yarn of a first pair of transverse or weft yarns, between a second upper yarn and a second lower yarn of a second pair of transverse or weft yarns adjacent the first pair, below a third lower yarn of a third pair of transverse or weft yarns adjacent the second pair, and between a fourth upper yarn and a fourth lower yarn of a fourth pair of transverse or weft yarns adjacent the third pair. For example, transverse yarn 2 passes above upper yarn 5 of a first pair of transverse yarns 5 and 6, between a second upper yarn 7 and a second lower yarn 8 of a second pair of transverse yarns 7 and 8 adjacent the first pair 5 and 6, below a third lower yarn 10 of a third pair of transverse yarns 9 and 10 adjacent the second pair 7 and 8, and between a fourth upper yarn 11 and a fourth lower yarn 12 of a fourth pair 11 and 12 of transverse yarns adjacent the third pair 9 and 10. Other longitudinal or warp yarns 1, 3 and 4 follow the same repetitive sequence and similarly interweave with the transverse or weft yarns.

Considering the top view of the surface of the fabric, it will be seen that the weave results in the longitudinal yarns being substantially perpendicular to the transverse yarns.

One novel aspect of the weave design is the fact that the weft weave has the same configuration as the warp weave. This can be seen by reference to FIG. 2 wherein the weft weave is shown. The longitudinal or warp yarns 105, 106, 107, 108, 109, 110, 111 and 112 form adjacent pairs 105 and 106, 107 and 108, 109 and 110, and 111 and 112. Transverse or weft yarn 102, for example, passes between warp yarns 105 and 106 of the first pair of yarns 105 and 106, below lower yarn 108 of the second pair of warp yarns 107 and 108 adjacent the first pair 105 and 106, between the third pair 109 and 110 adjacent the second pair 107 and 108, and above the upper warp yarn 111 of the fourth pair of warp yarns 111 and 112 adjacent the third pair 109 and 110.

The result is that the longitudinal yarns pass at recurrent intervals over, between, under and between the transverse yarns. Similarly, due to the equivalent configuration of the weft and warp and the symmetrical nature of the tubular fabric, the transverse yarns pass at recurrent intervals over, between, under and between the longitudinal yarns.

Another feature of this unique weave arrangement is that each transverse or weft yarn appears on the inner and outer surface of the tubular fabric. For example, consider in FIG. 2 the transverse or weft yarn 101. Note that a portion 101*a* of the transverse yarn 101 appears on the inner surface of the tubular fabric below longitudinal yarn 108. In addition, a portion 101*b* of transverse yarn 101 appears on the outer surface of the tubular fabric above the longitudinal yarn 111. The symmetry of the fabric and the equivalent weft-warp configuration also provides each longitudinal or warp yarn on the inner and outer surface of the tubular fabric. As FIG. 3 shows, a portion 1*a* of yarn 1 appears on the inner surface below transverse yarn 8 and a portion 1*b* appears on the outer surface above transverse yarn 11.

In such a structure, 66⅔% of the warp ends and 66⅔T of the weft ends appear on both the face and the back. In effect, this produces a tubular fabric which has longitudinal yarns arranged in a one-third broken twill order and transverse yarns similarly arranged in one-third broken twill order. Alternatively, the structure can be defined as an outer layer of yarns forming a single ply tubular fabric which is interwoven with an inner layer of yarns forming a single ply tubular fabric to form a two-ply tubular fabric configuration in a one-third broken twill order.

Moreover, it will be noted that the fabric disclosed is of a symmetrical construction such that the crossing points of adjacent warps are always equidistant from successive wefts of the face layer while successive wefts of the face layer are always directed above successive wefts of the back layer. This symmetrical construction is also applicable such that the crossing points of adjacent wefts are always equidistant from successive warps of the face layer, while successive warps of the face layer are always directly above successive warps of the back layer.

Viewing the features of the surface of the tubular fabric, it can be seen from FIGS. 2 and 3 that the longitudinal yarns are arranged in 4-end satin order and the transverse yarns are arranged in 4-end satin order as indicated by reference characters 1ES, 2ES, 3ES, and 4ES.

FIG. 3*a* is a section of the tubular fabric similar to FIG. 3 as can be noted by the corresponding reference characters, 201, 203, 203 and 204 denoting longitudinal warp yarns.

The weft yarns 101, 102, 103 and 104 are a single, continuous spiral of yarn. Actually, the weft yarns are a single continuously woven piece of yarn repeatedly assuming the positions of yarns 101, 102, 103 and 104. This aspect can be seen by reference to FIG. 2*a* wherein the inner warp yarns i and outer warp yarns j form 15 pairs and weft yarn W is woven in a pattern around the pairs in the four cycles shown. The result is that number of weft yarns is one plus a multiple of four. Cycle 1, cycle 2, cycle 3 and cycle 4 are exactly the same pattern but do not overlap because of the weft yarns numbering one plus a multiple of four, i.e. 15 in FIG. 2*a*.

Because the tubular fabric weave is recurrent, the planar structure of the tubular fabric is such that the longitudinal or warp yarns define, along with their recurrent corresponding longitudinal yarns, planes of warp yarn. Similarly, the transverse or weft yarns define with their recurrent corresponding transverse yarns, planes of weft yarn. For example, if warp yarn 1 and its recurrent corresponding warp yarns (not shown) are considered to define a first plane of warp yarns, then warp yarn 2 and its recurrent corresponding warp yarns (not shown) will define a second plane of warp yarns, warp yarn 3 and its recurrent corresponding warp yarns (not shown) will define a third plane of warp yarns and warp yarn 4 and its recurrent corresponding warp yarns (not shown) will define a fourth plane of warp yarns. If weft yarn 5 and its recurrent corresponding weft yarns (not shown) are considered to define a fifth plane of weft yarns, then weft yarn 6 and its recurrent corresponding weft yarns (not shown) define a sixth plane of weft yarns, weft yarn 7 and its recurrent corresponding weft yarns (not shown) define a seventh plane of weft yarns and weft yarn 8 and its recurrent corresponding weft yarns (not shown) define an eighth plane of weft yarn. The weft and warp yarns are interwoven, according to FIG. 3, such that the first and second planes, represented by warp yarns 1 and 2, respectively, bind the fifth plane represented by weft yarn 5 to the eighth plane represented by weft yarn 8. The third and fourth planes of warp yarn represented by warp yarns 3 and 4, respectively, bind the sixth plane represented by weft yarn 6 and the seventh plane represented by weft yarn 7.

FIGS. 2 and 3 in the above discussion are generally directed to the two-ply configuration of the tubular fabric. FIG. 4 is a diagram of the two-ply weave pattern used on a conventional loom to create the two-ply tubular fabric TF.

THREE-PLY

The tubular fabric can also be woven in a three-ply and four-ply configuration. Basically, the structure of the three-ply and four-ply fabric is the same as the two-ply configuration in that the weft of the weave has the same structure as the warp of the weave. FIG. 5 is a cross-sectional view of the warp weave of a three-ply fabric. As can be seen, the fabric consists of an upper two-ply fabric TF1 and a lower two-ply fabric TF2. The bottom layer of the tubular fabric TF1 is interwoven with a top layer of another tubular fabric TF2. In particular, the structure results in a base transverse or weft yarn 5A, 7A, 9A or 11A located below each pair 5 and 6, 7 and 8, 9 and 10, and 11 and 12 of transverse yarns. The longitudinal yarns are woven in the same relationship with the transverse yarns as a two-ply fabric. For example, warp yarn 2A passes above the first lower yarn 6, between the second lower yarn 8 and the second base yarn 7A below the second pair 7 and 8, below the third base yarn 9A below the third pair 9 and 10 and between the fourth lower yarn 12 and the fourth base yarn 11A below the fourth pair 11 and 12.

This three-ply construction results in the warp yarns 1A, 2A, 3A and 4A and the weft yarns 101A, 102A, 103A and 104A appearing only on the inner surface. In consequence thereof, the warp yarns 1, 2, 3 and 4 and the weft yarns 101, 102, 103 and 104 appear on the outer surface only of the tubular member. In total, half of the warp and weft yarns appear on the inner surface only and half of the warp and weft yarns appear on the outer surface only.

The equivalent configuration of the weft weave and the symmetry of the fabric results in the weft weave as shown in FIG. 6. Base longitudinal yarns 105A, 107A, 109A and 111A are located below each pair 105 and 106, 107 and 108, 109 and 110, and 111 and 112 of the longitudinal yarns. For example, longitudinal yarn 105A passes above the first lower yarn 106, between the second lower yarn 108 and the second base yarn 107A below the second pair 107 and 108, below the third base yarn 109A below the third pair 109 and 110 and between the fourth lower yarn 112 and the fourth base yarn 111A below the fourth pair 111 and 112.

With regard to the three-ply warp weave in FIG. 5, if you consider that warp yarn 1A and its recurrent corresponding warp yarns form a first additional plane of warp yarns, then warp yarns 2A and its recurrent corresponding warp yarns form a second additional plane of warp yarns, warp yarn 3A and the recurrent yarns corresponding thereto form a third additional plane of warp yarns and warp yarn 4A along with the recurrent yarns corresponding thereto form a fourth additional plane of warp yarns. Similarly, additional planes of weft yarn include fifth additional and seventh additional planes corresponding to transverse yarns 5A and 7A, respectively. The result is that the first additional plane of warp yarn and second additional plane of warp yarn, represented by yarns 1A and 2A, respectively, bind the sixth plane of weft yarn represented by yarn 6 and the seventh additional plane of weft yarn represented by yarn 7A and the third additional plane represented by yarns 3A and the fourth additional plane represented by yarn 4A bind the fifth additional plane represented by yarn 5A to the eighth plane represented by yarn 8.

FIG. 7 is a diagram of the weave pattern which would be employed on a conventional loom to provide a tubular fabric which has a three-ply configuration of the weave pattern described above. An example of three-ply fabric of the disclosed weave can be woven from a warp of 8/3 K./P. cotton and a weft of 1-220/4/2 polyester using a number 13 steel reed with as many picks per inch as possible.

FOUR-PLY

It is also possible to weave the tubular fabric in a four-ply configuration on 24 shafts wherein a bottom layer of the tubular fabric TF2 is interwoven with a top layer of a tubular fabric TF3. Alternatively, the top layer of the tubular fabric TF1 can be interwoven with a bottom of another tubular fabric to result in the same structure as shown in FIG. 8.

This four-ply configuration results in top transverse or weft yarns 6A, 8A, 10A and 12A located above each pair and base warp yarns 5, 6 and 5A; 7, 8 and 7A; 9, 10 and 9A; and 11, 12 and 11A, respectively. In addition, the yarns of the four-ply fabric have the same relationship as the yarns in the two-ply and three-ply fabrics. For example, yarn 14 passes over the first top yarn 6A above the first pair 5 and 6, between the second top yarn 8A above the second pair 7 and 8 and the second upper yarn 7, below the third upper yarn 9 of the third pair 9 and 10 and between the top fourth yarn 12A above the fourth pair 11 and 12 and the fourth upper yarn 11.

This four-ply construction results in the warp yarns 1A, 2A, 3A and 4A appearing only on the inner surface, the warp yarns 13, 14, 15 and 16 appearing only on the outer surface of the tubular member, and the warp yarns 1, 2, 3 and 4 not appearing on either surface of the tubular member. The weft yarns have the same configuration (not shown). In total, one-third of the warp and weft yarns appear on the inner surface only, one-third of the warp and weft yarns appear on the outer surface only, and one-third of warp and weft yarns do not appear on either surface.

In a planar configuration, this results in thirteenth, fourteenth, fifteenth and sixteenth planes of warp yarn represented by warp yarns 13, 14, 15 and 16 and sixth additional and eighth additional planes of weft yarn represented by weft yarns 6A and 8A. The thirteenth plane and the fourteenth plane bind the sixth additional plane to the seventh plane and the fifteenth plane and the sixteenth plane bind the fifth plane to the eighth additional plane.

In modern machinery such as complicated paper moving machinery, there is no room for belt tensioning devices so that a belt with a small amount of stretch being endless can create enough belt tension to transmit the required power over long periods of time. By using the yarns such as nylon which have a good modulus of elasticity, in combination with impregnations which are soft and elastic, the required stretch and control can be devised in cooperation with the tubular fabric disclosed herein.

There are many ways that the tubular fabric properties can be enhanced by coating or impregnation. For example, elastomer solutions can be used for impregnation of the fabric and can be fully polymerized, the elastomer being dissolved. Alternatively, the elastomer can be polymerized in solutions such as polyurethanes. Other endless belt impregnations include latices, thermoplastic calendering and thermoset multi-component systems such as applied in fluid form and then cured.

Elastomers which may be used to impregnate the endless belt include natural and synthetic rubbers, fluorocarbon elastomers, polyurethanes and polyesters such as Mylar and Hytrel.

With the above impregnating devices, the required different face and back characteristics can be produced such that high friction on one side of the tubular fabric exists and lower friction on the other side of the tubular fabric exists. This is applicable for such use as mail equipment. On the other hand, such impregnations provide for a soft fabric material which has a wear resistant surface applicable for high speed belting. Additionally, chemical resistance by the use of teflon fluorocarbon yarns and elastomers may also be applied to the tubular fabric. Heat resistance using fiberglass yarns with fluorocarbon elastomers as a coating is also a possible embodiment for use in combination with a tubular fabric.

These coatings are only effective and important if they have the proper belt woven to carry such additives. With the balanced weave, correct positioning of each yarn of the disclosed tubular fabric, members are produced which have evenly stressed load carrying ability to give long life and efficient performance.

Various changes may be made in the details of the invention, as disclosed, without sacrificing the advantages thereof or departing from the scope of the appending claims. Furthermore, although the present invention has been discussed with particular regard to its exceptional advantages in terms of a carcass for power transmission and conveyor belts, it may be understood that the invention may be employed in several industrial applications requiring tubular fabrics.

What is claimed is:

1. A tubular fabric for use as a carcass for power transmission and conveyor belts comprising:
(a) a plurality of longitudinal yarns;
(b) a plurality of transverse yarns interwoven with said longitudinal yarns;
(c) said longitudinal and transverse yarns forming a warp weave wherein said transverse yarns form adjacent pairs having upper yarns and lower yarns and said longitudinal yarns pass above a first upper yarn of a first pair of transverse yarns, between a second upper yarn and a second lower yarn of a second pair of transverse yarns adjacent the first pair, below a third lower yarn of a third pair of transverse yarns adjacent the second pair, and between a fourth upper yarn and a fourth lower yarn of a fourth pair of transverse yarns adjacent the third pair; and
(d) said longitudinal yarns forming first, second, third and fourth substantially parallel planes; said transverse yarn forming fifth, sixth, seventh and eighth substantially parallel planes; said first and second planes binding said fifth plane and said eighth plane; and said third and fourth planes binding said sixth plane to seventh plane.

2. A tubular fabric weave for use in making a carcass of power transmission and conveyor belts comprising:
(a) first, second, third and fourth planes of warp yarn;
(b) fifth, sixth, seventh and eighth planes of weft yarn interwoven with said planes of warp yarn;
(c) said first and second planes binding said fifth plane and said eighth plane; and
(d) said third and fourth planes binding said sixth plane and said seventh plane.

3. The tubular fabric of claim 2 wherein said planes of warp yarn include first additional, second additional, third additional and fourth additional planes and said planes of weft yarn include fifth additional and seventh additional planes, said first additional plane and second additional plane binding said sixth plane and said seventh additional plane and said third additional plane and said fourth additional plane binding said fifth additional plane and said eighth plane.

4. The tubular fabric of claim 2 wherein said planes of warp yarn include thirteenth, fourteenth, fifteenth and sixteenth planes and said planes of weft yarn include sixth additional and eighth additional planes, said thirteenth plane and said fourteeth plane binding said sixth additional plane to said seventh plane and said fifteenth plane and said sixteenth plane binding said fifth plane to said eighth additional plane.

* * * * *